United States Patent [19]

Urquhart et al.

[11] Patent Number: 4,541,913

[45] Date of Patent: Sep. 17, 1985

[54] PROCESS FOR HYDROCRACKING SUPERCRITICAL GAS EXTRACTS OF CARBONACEOUS MATERIAL

[75] Inventors: Donald B. Urquhart, Cheltenham; Stephen A. Moore, Evesham, both of England

[73] Assignee: Coal Industry (Patents) Limited, London, England

[21] Appl. No.: 433,519

[22] Filed: Oct. 8, 1982

[30] Foreign Application Priority Data

Oct. 16, 1981 [GB] United Kingdom ..... 8131227

[51] Int. Cl.[4] ..... C10G 1/08

[52] U.S. Cl. ..... 208/8 LE; 208/10

[58] Field of Search ..... 208/10, 8 LE

[56] References Cited

U.S. PATENT DOCUMENTS

| | | | |
|---|---|---|---|
| T700485 | 4/1969 | Hemminger et al. | 208/8 LE |
| 3,018,242 | 1/1962 | Gorin | 208/8 LE |
| 3,188,179 | 6/1965 | Gorin | 208/10 |
| 4,019,975 | 4/1977 | Uruqhart | 208/10 |
| 4,152,244 | 5/1979 | Raichle et al. | 208/10 |
| 4,235,702 | 11/1980 | Smith | 208/87 |
| 4,331,531 | 5/1982 | Kuehler | 208/10 |
| 4,447,310 | 5/1984 | Derbyshire et al. | 208/8 LE |
| 4,485,003 | 11/1984 | Coenen et al. | 208/10 |

OTHER PUBLICATIONS

Maddocks et al., "Coal Processing Technology: Supercritical Extraction of Coal", CEP, Jun. 1979.

"Conversion of Coal to Liquid Products Using Supercritical Extraction", Chem. Abst. 93:50189.

Maddocks et al., "Supercritical Extraction of Coal–Update", AICHE Conference, Nov. 1978.

*Primary Examiner*—D. E. Gantz

*Assistant Examiner*—Lance Johnson

*Attorney, Agent, or Firm*—Stevens, Davis, Miller & Mosher

[57] ABSTRACT

The present invention relates to a process for hydrocracking SGE of carbonaceous material to produce light distillate, including chemical feedstocks and transport fuels.

A mixture of crushed coal and a solvent is fed to an extractor 1 wherein the solvent is heated and pressurized to form a supercritical gas. Carbonaceous material is extracted from the coal into the gas. The unextracted coal, including ash and some carbonaceous material, is separated from the SGE in solution in the supercritical solvent in a separation stage 2. The SGE in the solvent is maintained in the supercritical state and fed to a hydrocracking stage 3 wherein it is mixed with excess hydrogen. After hydrocracking, the SGE in supercritical solution is passed through a pressure let-down valve 4 to a distillation stage 5 wherein the product of the hydrocracking stage 3 is separated into gases, solvent for recycling, light distillate and material boiling above 350° C. The light distillate may be further treated to produce transport fuels.

12 Claims, 1 Drawing Figure

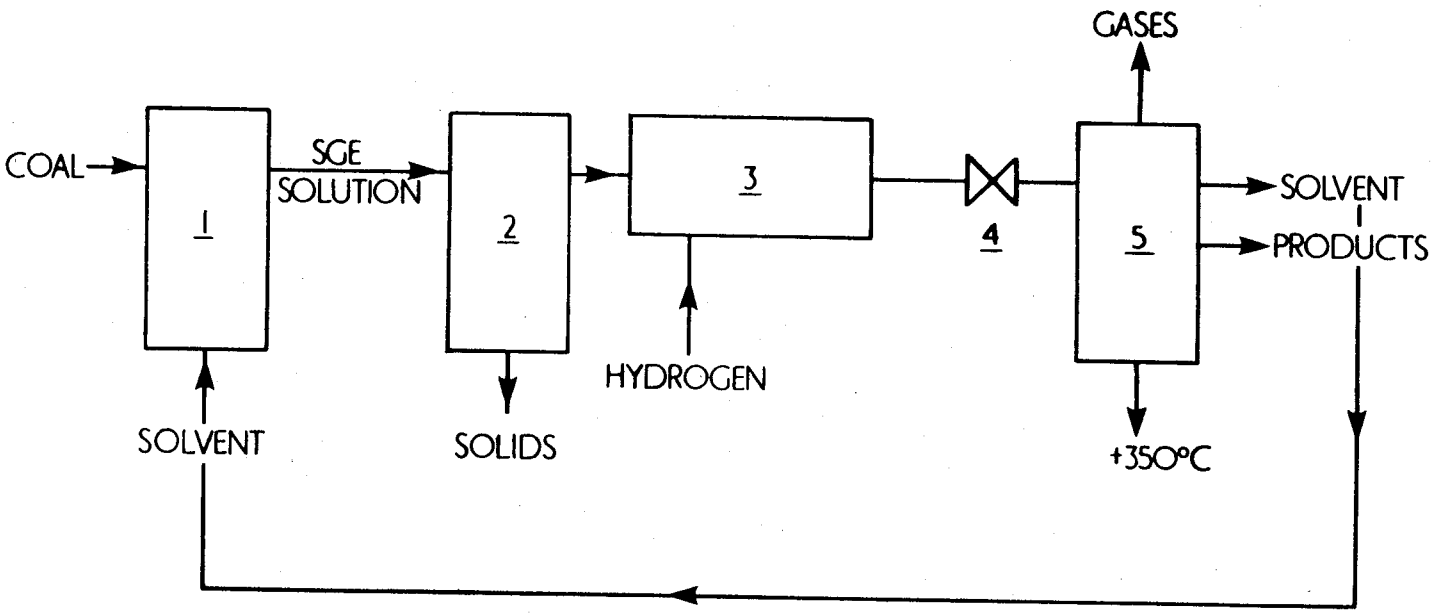
COAL
1
SOLVENT
SGE
SOLUTION
2
SOLIDS
3
HYDROGEN
4
5
GASES
+350°C
SOLVENT
PRODUCTS

PROCESS FOR HYDROCRACKING SUPERCRITICAL GAS EXTRACTS OF CARBONACEOUS MATERIAL

The present invention relates to a process for hydrocracking supercritical gas extracts of carbonaceous materials to produce light distillates (boiling below about 350° C. at atmospheric pressure), such as chemical feedstocks and transport fuels.

At present most light distillates, and in particular transport fuels, are derived from crude oil. However, as the world's reserves of crude oil are limited, it is becoming necessary to be able to produce light distillates from other sources. Much work has been carried out on the conversion of carbonaceous material, in particular coals but also lignites, oil shales and tar sands, to light distillates.

The process of supercritical gas extraction has been investigated for this purpose. The carbonaceous material is mixed with a solvent and heated under pressure to a temperature above the solvent's critical temperature. Under these conditions the solvent is present as a dense gaseous medium which in some ways is similar to a liquid, in that large quantities of certain components of the carbonaceous material can be dissolved in the medium. However, as it is a gas, it is easy to separate the gaseous phase from the solid phase by conventional gas/solid separation means. The separation stage produces a supercritical gas extract (SGE) dissolved in the gaseous solvent and a solid residue comprising unextractable carbonaceous material and mineral matter. The SGE is separated from the solvent by depressurising and cooling the mixture and distilling off the solvent. The SGE comprises the extractable components of the carbonaceous material substantially free from unextractable components and mineral matter.

Generally a SGE has a low hydrogen content and high molecular weight. However, the desired light distillates have a high hydrogen content and a low molecular weight. To obtain light distillates, including transport fuels, from a SGE it is therefore necessary to hydrogenate it and reduce its molecular weight. This is achieved by heating the SGE to 400° C. or above and passing it with hydrogen under pressure over a catalyst. Typically, 100 parts of SGE will be converted to 30–40 parts of light distillate, 5–10 parts of hydrocarbon gases and 40–60 parts of material boiling above 350° C. It can thus be seen that the hydrocracking process is not very efficient in converting SGE to light distillate in one pass. Moreover, some loss of thermal efficiency is involved in cooling and reheating the SGE before hydrocracking.

It is an object of the present invention to provide a process for hydrogenating a SGE which at least in part overcomes the disadvantages of the presently used processes.

Therefore according to the present invention, a process for hydrocracking a SGE comprises passing a solution of the SGE in a solvent in the supercritical state with hydrogen gas over a hydrogenation catalyst under hydrogenative conditions.

Preferably the solution of the SGE in a solvent is taken directly from a gas/solid separation means which has been used to separate a residue from a SGE solution in a conventional supercritical gas extraction process. This will eliminate the necessity of storing a solution of SGE in a supercritical solvent at high temperature and pressure. Clearly, the solution may be prepared by taking a SGE and solvent at ambient temperature and heating them to supercritical conditions. However, this would add process steps which are undesirable and should therefore be avoided if possible. The process of the invention differs from previous processes in that the solvent is also fed to the hydrocracking step. Therefore, if solvent is susceptible to hydrogenation, some of the hydrogen feed will be used in hydrogenating the solvent.

In one mode of operation of the invention, it may be undesirable to use a solvent which may be hydrogenated, as the hydrogenation will alter its characteristics and may reduce its extractive power. In this case it is preferred that the solvent is not substantially susceptible to hydrogenation under the conditions used.

However, in another mode of operation of the invention, it may be desirable to use a solvent which can at least in part be hydrogenated. For instance, in some supercritical extraction processes it is known that the use of a solvent containing a hydrogen donor improves the yield of SGE. (A hydrogen donor is a material capable of transferring hydrogen directly from itself to a substrate.) Where such a solvent is used, it must be rehydrogenated before it is recycled. Therefore, if a hydrogen donor is included in the solvent, the process of the present invention will also cause the rehydrogenation of the hydrogen donor, thus eliminating one of the steps of the solvent recovery operation. In this case, therefore, it is advantageous to use the present process with solvent-containing components which can be hydrogenated.

It is preferred that the conditions for hydrogenation are 380°–480° C. and 50–750 bar. Advantageously the temperature is from 400° C. to 440° C. and the pressure 130–250 bar. Under these conditions solvents which will be in the supercritical state include toluene, decalin, their homologues and mixtures thereof. Preferably, the solvent comprises a fraction distilled from a SGE containing predominantly mononuclear aromatic and naphthenic molecules. The solvent will be chosen to be susceptible to hydrogenation (hydrogen donor) or not depending on the material to be extracted to produce the SGE.

The catalyst may be a metal sulphide from Group VIB or Group VIIIB of the Periodic Table. Suitable catalysts include Co or Ni and Mo or W sulphides or a combination thereof on a support. The support may be γ-alumina, clay, active carbon, zinc oxide, magnesium oxide, aluminosilicates, silica, chromia, carbon etc. A number of this type of hydrogenation catalysts are commercially available.

The amount of hydrogen used will be determined so that the solvent is not significantly diluted by it, thus reducing the solvent power of the solvent and causing the SGE at least in part to precipitate. However, sufficient hydrogen must be present in order to drive the hydrogenation reactions towards completion. Conveniently, the gas hourly space velocity of the process will be from 2 to 20, preferably at least 3, $hr^{-1}$.

After the hydrocracking of the SGE, the product is separated into gases, including excess hydrogen, solvent, light distillate and high boiling materials in conventional manner. The hydrogen and solvent are preferably recycled to the process.

It has been found that the process of the present invention provides many advantages over previously used processes. The most unexpected of these is that the yield of light distillate (liquids boiling below 350° C.) is substantially greater than that obtained by previous processes for the same hydrogenating conditions. Typically 100 parts of SGE (excluding solvent) on hydrocracking according to the present process will give 70–80 parts of light distillate, about the same amount of gas (5–10 parts) and substantially less high boiling material (up to about 20 parts). Thus in this respect alone the process of the present invention is a significant advance in the art. Moreover, it has been found that there is less coke deposition on the catalyst, thus increasing the time for which the process can be run before catalyst regeneration. This effect is increased by the fact that sulphur on a sulphided catalyst is not removed as fast as it is in previously used processes.

Analyses of the products of the hydrocracking process have indicated that the high boiling material has lower hydrogen content than similar material produced in previous processes. The hydrogen is therefore being more efficiently used in producing light distillate. Since hydrogen is very expensive, this is a useful economic advantage of the present process.

Is is believed that these advantages at least in part stem from the fact that the hydrocracking in the present process is a two phase reaction, whereas the previously used processes use a three phase reaction. However, the Applicants do not wish to be limited by this explanation, which does not of itself form part of the invention.

Further economic and practical advantages of the present process are a reduction in the number of heating and storage stages needed and a simplification of the pumping and metering equipment needed in such a plant.

It is envisaged that the present invention will be of particular, but not exclusive, use in the preparation of light distillate from coal.

The present invention will now be described by way of example only with reference to the accompanying drawing which shows diagrammatically a coal processing plant including a stage operating according to the invention.

EXAMPLE 1

Referring now to the drawing, the coal processing plant includes a conventional supercritical gas extraction apparatus 1 to which are fed a crushed bituminous coal and a solvent comprising a distillate fraction from a hydrocracked SGE. The solvent will contain aromatic and naphthenic molecules. The mixture in a ratio of 4 parts of solvent to 1 part of coal, is heated to 420° C. at a pressure of 200 bar and held under these conditions for about five minutes. During this time the solvent is in a supercritical state and extractable components of the coal are dissolved therein. The mixture is maintained in the supercritical state and is fed to a separation stage 2 of conventional construction wherein mineral matter and unextractable coal material are separated from the solution of SGE.

The SGE is solution under supercritical conditions is fed to hydrocracker stage 3. The stage 3 contains a bed of a catalyst (Akzo 153S, supplied by Akzo Chemie, Nederland BV) which comprises Ni and Mo supported on $\gamma$-alumina. The catalyst was presulphided before use. Hydrogen gas at a pressure of 200 bar is fed to the stage 3 and intimately mixed with the supercritical solution. The hydrocracking stage 3 is also maintained at 420° C. and a pressure of 200 bar. The SGE solution is passed through the stage 3 at a gas hourly space velocity of 3.2 $hr^{-1}$.

On emerging from the hydrocracking stage 3, the SGE in a mixture of hydrogen and supercritical solvent is passed through a let-down valve 4 wherein the pressure in the solution is reduced. The SGE solution is also cooled. This causes the formation of a liquid and some gas. The gas is separated off and the liquid is fed to a distillation apparatus 5, wherein solvent is distilled off and recycled to the extraction stage 1. The SGE is fractionated into light distillate (boiling below 350° C.) and a heavy product containing material boiling above 350° C.

The conditions of the process as a whole and the yields of various fractions are summarised in the Table I below.

TABLE I

| | |
|---|---|
| Extraction Stage: | |
| Temp. | 420° C. |
| Press. | 200 bar |
| Solvent. | toluene |
| Solvent: Coal | 4:1 |
| Residence Time | 6.5 minutes |
| Extract yield | 26.9% (based on dry, ash free coal) |
| Residue yield | 58.0% (based on dry, ash free coal) |
| Gas yield | 7.0% (based on dry, ash free coal) |
| Hydrocracking Stage: | |
| Temp. | 420° C. |
| Press. | 200 bar |
| GHSV | 3.2 $hr^{-1}$ |
| Hydrogen input | 15.5% (based on weight of extract feed) |
| Hydrogen consumption | 13.1% (based on weight of extract feed) |
| Distillate yield | 73.9% (based on weight of extract feed) |
| Gas yield | 11.7% (based on weight of extract feed) |
| +350° C. yield | 17.6% (based on weight of extract feed) |

Analysis by proton N.M.R. of the +350° C. material from the distillation showed that it was more aromatic than a similar material from previous processes. The light distillate was suitable for further processing to produce, for instance, transport fuels. The catalyst was weighed before and after the run, and on the basis of this and visual inspection it was found to have less coke deposited on it than expected. Analysis of the catalyst also showed that it had lost less sulphur than expected.

Thus the present invention provides a process for hydrocracking SGE which is a significant improvement over previously used processes both in its efficiency of conversion and use of hydrogen, and in its economic advantages.

EXAMPLE 2

Using the apparatus of Example 1 and using the same solvent, the process given in Example 1 was carried out with the variations detailed in Table 2 below. A reduced quantity of catalyst was used and a gas hourly space velocity of 13.1 $hr^{-1}$, similar to GSHV's used in liquid phase hydrocracking, was used. The hydrogenated extract boiling above 300° C. was reduced to 51% of the extract feed, which is considered very satisfactory with a relatively low hydrocracking temperature of 410° C.

EXAMPLE 3

Using the apparatus of Example 1, using as solvent a mixture of 40% methyl naphthalene and 60% decalin, having a higher boiling point and critical temperature than toluene, an enhanced extract yield of 56% is achieved. This is higher than would be economically desirable in a commercial plant and contains higher molecular weight coal-derived components which are more difficult to hydrocrack. Despite this, and using a very high GHSV corresponding to about one quarter of the amount of catalyst used for conventional liquid phase hydrocracking of such material, only 66% of the hydrogenated extract boiled above 300° C. A gas yield of 26% consisted largely of methane and is believed to result in the main from de-alkylation of the methyl naphthalene solvent component. The processing conditions and results for this Example are given in Table 2 below.

TABLE 2

| | | Example 2 | Example 3 |
|---|---|---|---|
| Extraction Step | | | |
| Temperature | °C. | 410 | 420 |
| Pressure | bar | 200 | 200 |
| Solvent | | Toluene | decalin/methyl naphthalene |
| Solvent/coal | wt ratio | 4 | 4 |
| Residence Time | min | 4.3 | 3.1 |
| Extract Yield | % daf coal | 24.8 | 55.7 |
| Residue Yield | % daf coal | 73.7 | 33.2 |
| Gas Yield | % daf coal | 3.6 | 7.9 |
| Hydrocracking Step | | | |
| Temperate | °C. | 410 | 440 |
| Pressure | bar | 200 | 200 |
| GHSV | $hr^{-1}$ | 13.1 | 22.6 |
| $H_2$ input | % extract wt | 10.00 | 3.0 |
| $H_2$ consumed | % extract wt | 7.4 | 0.6 |
| Gas yield | % extract wt | 12.2 | 25.9 |
| +300° C. liquid yield | % extract wt | 50.7 | 65.7 |

We claim:

1. A process for hydrocracking supercritical gas extract from carbonaceous material consisting essentially of contacting carbonaceous material with a solvent at supercritical conditions to form a supercritical extract, passing said extract and solvent with hydrogen gas over a hydrocracking catalyst under hydrocracking conditions whereby said conditions are above the critical temperature of the solvent.

2. The process of claim 1, wherein the solvent is not substantially susceptible to hydrogenation.

3. The process of claim 1, wherein the solvent comprises at least one hydrogen donor component.

4. The process of claim 1, wherein the hydrocracking conditions comprise a temperature from 380° to 480° C. and a pressure from 50 to 750 bar.

5. The process of claim 4, wherein the hydrocracking conditions comprise a temperature from 400° to 440° C. and a pressure from 130 to 250 bar.

6. The process of claim 1, wherein the solvent comprises decalin, toluene, a mononuclear aromatic, a naphthenic or a mixture thereof.

7. The process of claim 1, wherein the solvent comprises a distillate fraction of material produced by the hydrocracking process.

8. The process of claim 1, wherein the catalyst comprises a supported metal sulphide from Group VIB or VIII.

9. The process of claim 1, wherein the gas hourly space velocity of the hydrocracking process comprises from 1 to 20 $hr^{-1}$.

10. A process of claim 9, wherein the gas hourly space velocity comprises at least 3 $hr^{-1}$.

11. A process for the supercritical hydrocracking of an extract from a supercritical gas extraction of carbonaceous materials consisting essentially of extracting a carbonaceous material using a solvent at a temperature above its critical temperature, separating the extract in its supercritical solvent from a solid residue and introducing the extract and solvent to a supercritical hydrogenation stage wherein the extract and solvent are passed over a hydrocracking catalyst a temperature above the critical temperature of the solvent, with hydrogen, under hydrocracking conditions.

12. A process for supercritical gas extraction with subsequent hydrocracking of supercritical gas extract of carbonaceous material comprising:

extracting a carbonaceous material using solvent at a temperature above critical temperature of the solvent;

separating supercritical gas extract dissolved in gaseous solvent under supercritical conditions from solid residue containing unextractable carbonaceous material and mineral matter; and then hydrogenating the supercritical gas extract dissolved in gaseous solvent under supercritical conditions with hydrogen gas over hydrogenation catalyst under hydrogenation conditions.

* * * * *